US005819853A

United States Patent [19]

Patel

[11] Patent Number: 5,819,853

[45] Date of Patent: Oct. 13, 1998

[54] RUPTURE DISC OPERATED VALVES FOR USE IN DRILL STEM TESTING

[75] Inventor: Dinesh R. Patel, Sugar Land, Tex.

[73] Assignee: Schlumberger Technology Corporation, Houston, Tex.

[21] Appl. No.: 512,726

[22] Filed: Aug. 8, 1995

[51] Int. Cl.[6] ..... E21B 34/10

[52] U.S. Cl. ..... 166/373; 166/386; 166/319

[58] Field of Search ..... 166/319, 386, 166/373, 374, 321, 323, 264

[56] References Cited

U.S. PATENT DOCUMENTS

| | | | |
|---|---|---|---|
| Re. 29,638 | 5/1978 | Nutter . | |
| 4,440,230 | 4/1984 | McGill . | |
| 4,474,242 | 10/1984 | Upchurch . | |
| 4,553,598 | 11/1985 | Meek et al. . | |
| 4,576,234 | 3/1986 | Upchurch . | |
| 4,597,439 | 7/1986 | Meek . | |
| 4,609,005 | 9/1986 | Upchurch | 166/317 X |
| 4,610,308 | 9/1986 | Meek . | |
| 4,619,325 | 10/1986 | Zunkel | 166/374 |
| 4,760,879 | 8/1988 | Pringle | 166/117.5 |
| 4,979,569 | 12/1990 | Anyan et al. . | |
| 5,193,621 | 3/1993 | Manke et al. | 166/386 |
| 5,275,241 | 1/1994 | Vigor et al. . | |
| 5,341,883 | 8/1994 | Ringgenberg . | |
| 5,411,097 | 5/1995 | Manke et al. | 166/324 |

*Primary Examiner*—Frank Tsay
*Attorney, Agent, or Firm*—John H. Bouchard; John J. Ryberg

[57] ABSTRACT

A valve adapted to be disposed in a wellbore for use during a drill stem test includes one or more rupture discs which, when ruptured by one or more annulus pressures or a tubing pressure, moves a mandrel in either of two different longitudinal directions. When the mandrel is moved, one of four possible events could occur. First, a pair of flapper valves will close, and, after the pair of flapper valves close, a reversing port will open. Second, a ball valve will successively close and open and, simultaneously, a reversing port will successively open and close. Third, a port will move into congruence with a one-way check valve allowing a fluid to flow from within an internal area within the valve to an external area around the valve. Fourth, a port will move out of congruence with a one-way check valve thereby preventing a fluid from flowing from the external area around the valve to an internal area within the valve.

15 Claims, 2 Drawing Sheets

FIG. 3
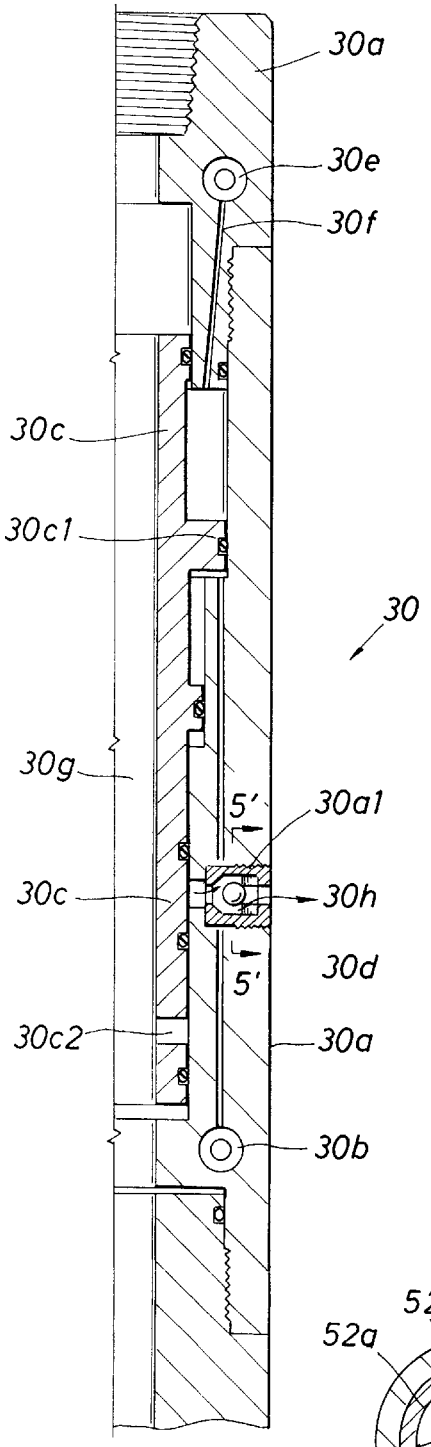
FIG. 4
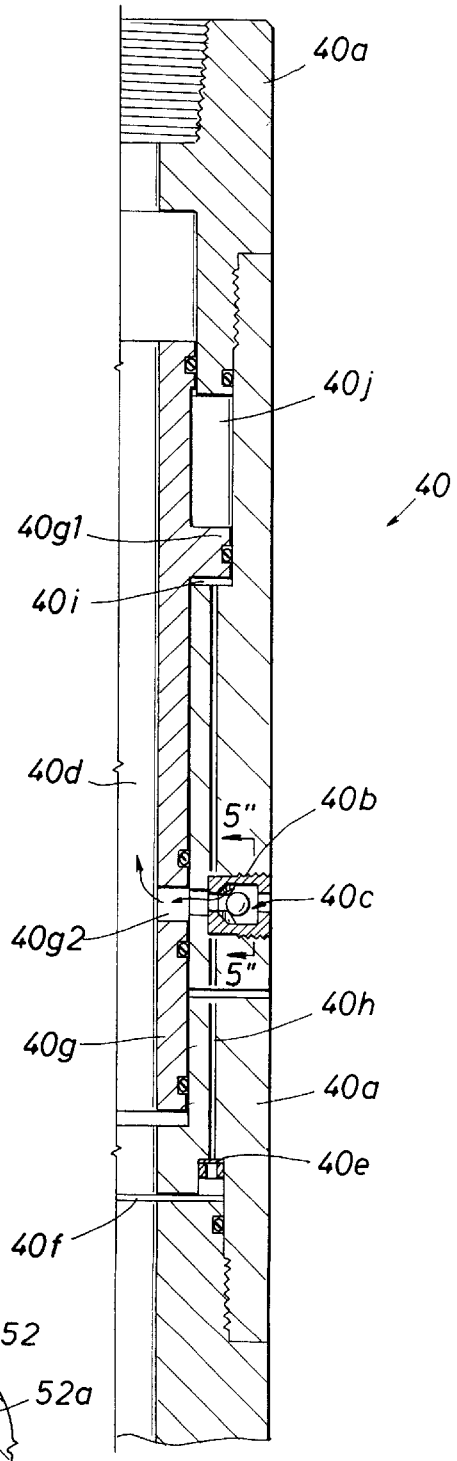
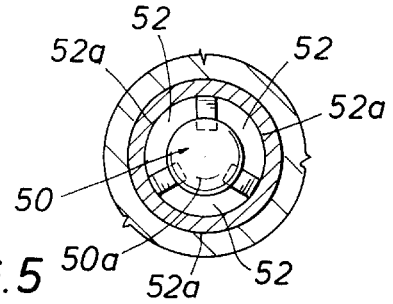
FIG. 5

RUPTURE DISC OPERATED VALVES FOR USE IN DRILL STEM TESTING

BACKGROUND OF THE INVENTION

The subject matter of the present invention relates to valves adapted for use during drill stem testing, and more particularly to drill stem test valves which include one or more rupture discs that are used in conjunction with either flapper valves, check valves, or ball valves for performing different functions in different ways and producing different results.

Rupture discs have been used in conjunction with valves during a drill stem test. For example, in U.S. Pat. No. 4,979,569 to Anyan et al, a pair of rupture discs are used, one for opening a ball valve, and another for closing the ball valve. However, other U.S. Patents disclose a rupture disc which, when ruptured in response to a predetermined pressure, will allow a valve to either open or close.

It should become evident that there are many different types of valves, adapted to be disposed in a wellbore during a drill stem test, which can be operated in different ways to perform different functions when one or more rupture discs are ruptured in response to a predetermined pressure existing in a tubing string disposed in the wellbore or in an annulus of the wellbore.

This specification discloses four different types of valves adapted to be disposed in a wellbore, each of which will utilize one or more rupture discs that, when ruptured in response to a predetermined pressure, will allow the valve to operate and perform a different function in a different way to produce a different result.

SUMMARY OF THE INVENTION

Accordingly, it is a primary object of the present invention to disclose valves adapted for use in a wellbore which include one or more rupture discs for performing different functions in different ways to produce different results.

It is a further object of the present invention to disclose and provide a first such valve known as a pump through flapper and safety valve adapted to be disposed in a wellbore including a pair of flapper valves, a reversing port, and a rupture disc, the rupture disc rupturing in response to a predetermined pressure in a wellbore, both of the flapper valves closing when the rupture disc ruptures, and the reversing port opening only after both of the flapper valves close.

It is a further object of the present invention to disclose and provide a second such valve known as a storm valve adapted to be disposed in a wellbore including a housing having a first port and a mandrel having a second port defining a reversing valve which is open when the first port is moved into congruence with the second port and is closed when the first port is not in congruence with the second port, a ball valve, and three separate rupture discs each of which is adapted to rupture, the reversing valve being initially closed and the ball valve being initially open, a closure state of the ball valve and the reversing valve being successively changed in response to the successive rupture of the first rupture disc, the second rupture disc, and the third rupture disc, respectively.

It is a further object of the present invention to disclose and provide a third such valve known as a nitrogen spotting valve adapted to be disposed in a wellbore including a pair of rupture discs, a mandrel having a port disposed therethrough and movable in response to a pressure from either of the rupture discs, and a flow restrictor or check valve, the port adapted to move into congruence with the check valve, the check valve allowing a fluid to flow from within the valve to an external annulus around the external periphery of the valve when the port in the mandrel is moved into congruence with the check valve in response to a pressure from one of the rupture discs, the fluid being prevented from flowing from within the valve to the external annulus when the port in the mandrel is moved out of congruence with the check valve in response to a pressure from the other of the rupture discs.

It is a further object of the present invention to disclose and provide a fourth such valve known as an auto cushion valve adapted to be disposed in a wellbore including a rupture disc, a mandrel having a port and a check valve adapted to allow fluid to flow from an external annulus around the valve, through the port, and into an internal area within the valve, the rupture disc rupturing and forcing the mandrel to move thereby moving the port in the mandrel out of congruence with the check valve, the fluid in the external annulus being prevented from flowing through the check valve, through the port and into the internal area when the port in the mandrel has moved out of congruence with the check valve in response to a pressure flowing through the rupture disc.

In accordance with these and other objects of the present invention, a valve adapted to be disposed in a wellbore for use during a drill stem test includes one or more rupture discs which, when ruptured by one or more annulus pressures or a tubing pressure, moves a mandrel in either of two different longitudinal directions. When the mandrel is moved, one of four possible events could occur. First, a pair of flapper valves will close, and, after the pair of flapper valves close, a reversing port will open. Second, a ball valve will successively close and open and, simultaneously, a reversing port will successively open and close. Third, a port will move into congruence with a one-way check valve allowing a fluid to flow only from within an internal area within the valve to an external area around the valve. Fourth, a port will move out of congruence with a one-way check valve thereby preventing a fluid from flowing from the external area around the valve to an internal area within the valve.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 1–4 illustrate four different valves, each of which operate to perform a different function in a different way to produce a different result when one or more rupture discs is ruptured in response to one or more pressures in an annulus around the valve which exceeds one or more predetermined threshold pressure values, FIG. 1 illustrating a construction of the pump-through flapper and safety valve, FIG. 2 illustrating a construction of the storm valve, FIG. 3 illustrating a construction of the nitrogen spotting valve, and FIG. 4 illustrating a construction of the auto cushion valve; and FIG. 5 illustrates a detailed construction of the check valves of FIGS. 3 and 4.

DETAILED DESCRIPTION OF THE PREFERRED EMBODIMENT

Figure 1:
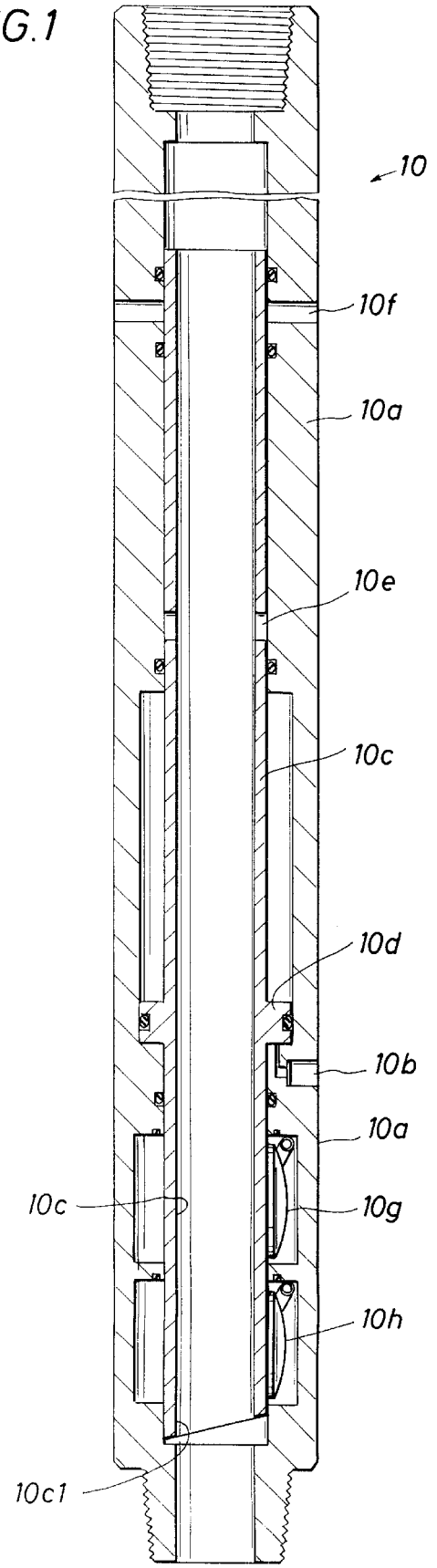

Referring to FIG. 1, a first valve known as a pump-through flapper and safety valve is illustrated.

Overbalanced testing with mud in an annulus makes drill stem testing safer but use of heavy mud affects downhole test tool reliability. Underbalanced testing with sea water or brine in an annulus is an alternative to overbalanced testing with mud. Clear fluid does not affects tool reliability but safety is compromised. A ball valve type safety valve could provide the reliable means for shutting-in the well in the event of a near surface tubing leak. However, having a closed ball in the flow path complicates the well kill. The pump-through flapper and safety valve of FIG. 1 will provide the reliable shut-in and ability to pump fluid into a formation penetrated by a wellbore to kill the well. Dual flappers provide additional reliability. A mandrel and rupture discs are biased to atmospheric pressure and are activated by absolute pressure. Hence, the valve will work even if there is a leak between tubing to casing. Once activated, it will shut off flow from the formation and it will always have the ability to pump-through to kill the well and to circulate and clean the contaminated annulus fluid. Automatic opening of the reversing valve after closing the flapper valves will save rig time and simplify the operation of the valve.

In FIG. 1, the pump through flapper and safety valve 10 comprises an outer housing 10*a* having a wall and a rupture disc 10*b* disposed through the wall of the outer housing 10*a*. The rupture disc 10*b* is designed to rupture when an external pressure around the valve 10 exceeds a predetermined threshold pressure value rating of the rupture disc 10*b*. The valve 10 further includes a mandrel 10*c* having a piston 10*d* protruding outwardly of the mandrel 10*c* and forming an integral part thereof. A port 10*e* is disposed through the mandrel 10*c*. The outer housing 10*a* further includes a reversing port 10*f* disposed through a wall of the outer housing 10*a*. A pair of flapper valves 10*g* and 10*h*, shown in an open position and adapted to close, are disposed between the outer housing 10*a* and the mandrel 10*c*.

In operation, referring to FIG. 1, the pump-through flapper and safety valve 10 is initially shown with the flapper valves 10*g* and 10*h* in an open position, but the port 10*e* in mandrel 10*c* and the reversing port 10*f* in the outer housing 10*a* are not in congruence with one another. Therefore, fluid cannot flow between the internal area within the valve 10 and the external area outside the valve 10. Pressure in an annulus around the valve 10 is increased beyond a predetermined threshold pressure value rating of the rupture disc 10*b*. As a result, the rupture disc 10*b* ruptures and the pressure is now exerted onto the piston 10*d* of the mandrel 10*c*. The mandrel 10*c* moves, in FIG. 1, upwardly. As the mandrel 10*c* moves upwardly in FIG. 1, the end portion 10*c*1 of the mandrel 10*c* moves past the bottom flapper valve 10*h* first, thereby allowing the bottom flapper valve 10*h* to close, and then past the upper flapper valve 10*g* second, thereby allowing the upper flapper valve 10*g* to close. After both of the flapper valves 10*h* and 10*g* have fully closed in response to the movement of the mandrel 10*c* upwardly in FIG. 1, the port 10*e* in mandrel 10*c* will then start to move into congruence with the reversing port 10*f* in the outer housing 10*a*. When the port 10*e* is congruent with the reversing port 10*f*, a wellbore or tubing fluid may then begin to flow between an internal area within the valve 10 and an external area around a periphery of the valve 10. This ensures that the well is shut-in before establishing annulus-to-tubing fluid communication.

Alternatively, a time delay, in the form of two oil chambers separated by an oil metering orifice, could be added to this valve 10 so that the reverse circulation ports 10*e*/10*f* will open a set time after the flapper valves 10*g*/10*h* close. In addition, the flapper valves can be changed such that one will hold pressure from below and the other from above.

Figure 2:
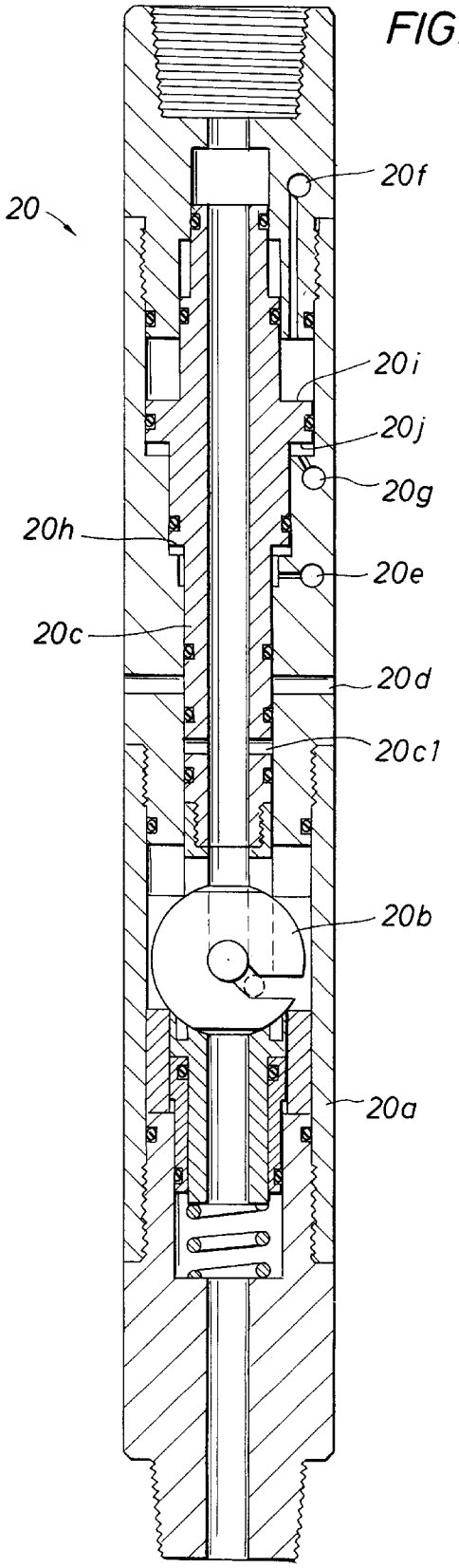

Referring to FIG. 2, a second valve known as a storm valve 20 is illustrated.

In an emergency situation, clients prefer to rapidly displace the content of a tubing with kill fluid before moving the rig off location; the rig is moved back, at which point, the kill fluid is displaced with cushion, the reversing valve is closed, and the drill stem test is resumed. The storm valve 20 will perform these operations. Tubing pressure operated valves are not suitable when there is a gas in the tubing because it takes a long period of time to increase tubing pressure to operate the tool. Tubing fluid does not hinder the operation of the storm valve, since it is annulus pressure operated.

In FIG. 2, the storm valve includes an outer housing 20*a* having a port 20*d* disposed therethrough, a ball valve 20*b* shown initially in an open position disposed within the housing 20*a*, and a mandrel 20*c* having a port 20*c*1 disposed therethrough which is adapted to move into congruence with the port 20*d* in the outer housing 20*a*. In FIG. 2, the ball valve 20*b* is shown in an open position and the ports 20*c*1 and 20*d*, which define a reversing port, is shown in a closed position since the ports 20*c*1/20*d* are not shown to be congruent with one another. The mandrel 20*c* includes two outwardly protruding pistons which protrude radially outwardly from the mandrel, the first piston having a working surface 20*h* and the second piston having two oppositely disposed working surfaces, a working surface 20*i* and a working surface 20*j*. The outer housing 20*a* further includes a first rupture disc 20*e* adapted to rupture in response to a first pressure greater than a first predetermined threshold pressure value rating of the first rupture disc, the first pressure being applied to the working surface 20*h* of the first piston. The outer housing 20*a* further includes a second rupture disc 20*f* adapted to rupture in response to a second pressure greater than a second predetermined threshold pressure value rating of the second rupture disc, the second pressure being applied to the working surface 20*i* of the second piston. The outer housing 20*a* further includes a third rupture disc 20*g* adapted to rupture in response to a third pressure greater than a third predetermined threshold pressure value rating of the third rupture disc, the third pressure being applied to the working surface 20*j* of the second piston.

In operation, referring to FIG. 2, assume that the ball valve 20*b* is initially open, as shown, and the reversing port 20*c*1/20*d* defined by ports 20*c*1 and 20*d* is initially closed, as shown in FIG. 2, since port 20*c*1 in mandrel 20*c* is not shown to be congruent with port 20*d* in the outer housing 20*a*.

The first pressure enters the first rupture disc 20*e*, and, since the first pressure is greater than the first predetermined threshold pressure value rating of the first rupture disc, first pressure bursts the first rupture disc 20*e*, and the first pressure is then exerted on the working surface 20*h* of the first piston. The first pressure moves the mandrel 20*c* upwardly in FIG. 2. When the mandrel 20*c* moves upwardly, the ball valve 20*b* rotates to a closed position and the reversing port 20*c*1/20*d* opens since the port 20*c*1 moves into congruence with the port 20*d* of the outer housing 20*a*. Now, the tubing content is reversed out and displaced by kill fluid. The well is killed and the rig can be moved off the location. The rig is brought back to the location. The kill fluid in the tubing is displaced with the cushion fluid. The pressure on the annulus is increased (the second pressure)

The second pressure enters the second rupture disc 20*f*, and, since the second pressure is greater than the second predetermined threshold pressure value rating of the second rupture disc, the second pressure bursts the second rupture disc 20*f*, and the second pressure is then exerted on the working surface 20*i* of the second piston. The working surface 20*i* is greater than (>) the working surface 20*h*. Hence, the second pressure moves the mandrel 20*c* downwardly in FIG. 2. When the mandrel 20*c* moves downwardly, the ball valve 20*b* rotates to an open position and the reversing port 20*c*1/20*d* closes since the port 20*c*1 moves out of congruence with the port 20*d* of the outer housing 20*a*. Now, the ball valve is open and the reversing ports are closed. The well can now begin to flow and a drill stem test is resumed.

At the end of the drill stem test, the third pressure enters the third rupture disc 20*g*, and, since the third pressure is greater than the third predetermined threshold pressure value rating of the third rupture disc, the third pressure bursts the third rupture disc 20*g*, and the third pressure is then exerted on the working surface 20*j* of the second piston. The third pressure moves the mandrel 20*c* upwardly in FIG. 2. When the mandrel 20*c* moves upwardly, the ball valve 20*b* rotates to a closed position and the reversing port 20*c*1/20*d* opens since the port 20*c*1 moves into congruence with the port 20*d* of the outer housing 20*a*. Now, the well is shut and a pressure build up drill stem test begins for reservoir analysis. At the same time, tubing fluid is reversed out and displaced by kill fluid. As a result, the well now exists in a safe condition. At the end of the pressure buildup, the pressure build test is terminated and tools are pulled out of the wellbore. The tubing fluid will now be drained through the reversing ports 20*c*1/20*d* as the tools are pulled out of the wellbore and, as a result, the valve of FIG. 2 will exist in a dry condition.

In summary, the storm valve 20 of FIG. 2 is a combined annulus pressure operated shut-in, circulating, and reversing valve. It is a rupture disc operated three cycle valve. The sequence of operation is as follows: (1) The ball valve 20*b* is run into the wellbore in an open condition and the circulating valve 20*c*1/20*d* is closed, (2) In response to a pressure in the annulus, blow disc #1, the ball valve closes and the circulating valve opens, then, reverse circulate, (3) In response to a pressure in the annulus, blow disc #2, the ball valve opens and the circulating valve closes, then, resume drill stem testing, and (4) At the end of the test, pressure the annulus, blow disc #3, the ball valve is closed, and the circulating valve is opened, then, reverse circulate, and pull the storm valve 20 out of the wellbore.

Referring to FIG. 3, a third valve known as a nitrogen spotting valve 30 is illustrated.

In FIG. 3, the nitrogen spotting valve 30 includes an outer housing 30*a*, a first rupture disc 30*b* disposed through a wall of the outer housing 30*a*, a mandrel 30*c* disposed within the outer housing 30*a* and movable within the outer housing in opposite directions, the mandrel 30*c* having a piston 30*c*1, a first fluid communication channel 30*d* fluidly communicating the first rupture disc 30*b* with one side of the piston 30*c*1 for moving the piston 30*c*1 in one direction when the first rupture disc 30*b* ruptures in response to a first predetermined annulus pressure and allows a fluid pressure to enter the channel 30*d* and move the mandrel 30*c* in the one direction, a second rupture disc 30*e* disposed through the outer housing 30*a*, and a second fluid communication channel 30*f* fluidly communicating the second rupture disc 30*e* with the other side of the piston 30*c*1 for moving the piston 30*c*1 in the other direction when the second rupture disc 30*e* ruptures in response to a second predetermined annulus pressure and allows a fluid pressure to enter the channel 30*f* and move the mandrel 30*c* in the other direction. The first predetermined annulus pressure exceeds the threshold pressure value rating of the first rupture disc 30*b* and therefore ruptures the first rupture disc 30*b*, and the second predetermined annulus pressure exceeds the threshold pressure value rating of the second rupture disc 30*e* and ruptures the second rupture disc 30*e*. The mandrel 30*c* includes a port 30*c*2 disposed therethrough, and the outer housing 30*a* includes a check valve 30*a*1 disposed therethrough, the port 30*c*2 adapted to move into alignment with the check valve 30*a*1 when the piston 30*c*1 moves in response to movement of the mandrel 30*c*. The check valve 30*a*1 is specially designed to allow a fluid to flow from within an internal area 30*g* of the nitrogen spotting valve 30 into an external area 30*h* of the valve via the check valve 30*a*1, but the check valve 30*a*1 will not allow any fluid to flow from the external area 30*h* to the internal area 30*g* via the check valve 30*a*1. As a result, since the check valve 30*a*1 will not allow any fluid to flow from the external area 30*h* to the internal area 30*g*, the first and second predetermined annulus pressure will not be able to pass through and enter the check valve 30*a*1 when such pressures are being applied to their respective rupture discs 30*b* and 30*e* for the purpose of rupturing the rupture discs.

In operation, referring to FIG. 3, the first predetermined annulus pressure is propagated down the annulus between the valve 30 and a wall of the wellbore. The check valve 30*a*1 will not allow the first predetermined annulus pressure to propagate from the external area 30*h* into the internal area 30*g* of the valve 30. As a result, the first predetermined annulus pressure can concentrate on the first rupture disc 30*b* and rupture the first rupture disc 30*b* (recall that the first predetermined annulus pressure exceeds the pressure rating of the first rupture disc 30*b*). The first predetermined annulus pressure enters the channel 30*d* and is applied to one side of the piston 30*c*1 of the mandrel 30*c* thereby moving the mandrel 30*c* in one direction. When the mandrel 30*c* moves in the one direction, the port 30*c*2 in the mandrel 30*c* moves into alignment with the check valve 30*a*1. Now, a fluid disposed in the internal area 30*g* of the valve 30 can be displaced with nitrogen gas; that is, the fluid in internal area 30*g* is forced out of the valve 30 by moving from within the internal area 30*g* of the valve 30, through the check valve 30*a*1 and into the external area 30*h* within the annulus around a periphery of the valve in the wellbore. The second predetermined annulus pressure is propagated down the annulus between valve 30 and the wall of the wellbore; it cannot propagate through the check valve 30*a*1; therefore, it can concentrate on the second rupture disc 30*e* for the purpose of rupturing the second rupture disc 30*e*. As a result, since the second predetermined annulus pressure exceeds the threshold pressure rating of the second rupture disc 30*e*, it ruptures the second rupture disc 30*e*, propagates through channel 30*f*, and is applied to the other side of piston 30*c*1 thereby moving the piston 30*c*1 and mandrel 30*c* in the other direction. When the mandrel 30*c* moves in the other direction, the port 30*c*2 in mandrel 30*c* moves out of alignment with the check valve 30*a*1 thereby shutting off the fluid communication between the internal area 30*g* and the external area 30*h* of the nitrogen spotting valve 30.

The nitrogen spotting valve 30 of FIG. 3 is a rupture disc annulus pressure operated downhole valve. The check valve 30*a*1 allows a fluid or gas to flow from the internal area 30*g* of the tubing to the annulus 30*h* but it checks (prevents) the flow of fluid or gas from the annulus 30*h* to the tubing 30*g*; as a result, annulus pressure can be increased for rupturing the disc for activating the tool. The tool is generally run in the wellbore in a closed position. Once on the bottom of the wellbore, the annulus pressure is increased, disc #1 30*b* is ruptured, the mandrel 30*c* moves forward and ports 30*c*2/30*a*1 are opened. Now, tubing fluid can be displaced with nitrogen. To close the ports again, the annulus pressure is increased, the check valve 30*a*1 will stop any annulus-to-tubing communication, disc #2 30*e* is ruptured, and the mandrel 30*c* moves down thereby closing the ports 30*c*2/30*a*1.

The nitrogen spotting valve is a simple valve which is suitable for hostile wells and wells requiring only one spotting operation. Check valves allow tubing fluid to be displaced with nitrogen gas but it checks the flow of fluid from the annulus to the tubing so that annulus pressure can be increased to activate the tool to close the ports. Without the check valve, it would take a long time to increase pressure for activating the tool because nitrogen gas must be compressed, whereas, with the check valve, annulus fluid is compressed to increase the pressure of the fluid in the annulus for the purpose of rupturing the rupture discs.

Referring to FIG. 4, a fourth valve known as an auto cushion valve 40 is illustrated.

In FIG. 4, the auto cushion valve 40 includes an outer housing 40*a*, a check valve 40*b* disposed through a wall of the outer housing 40*a*, the check valve 40*b* being specially designed to allow a fluid communication from an external area 40*c* (the annulus between the valve 40 and a wall of a wellbore when the valve is disposed in the wellbore), through the check valve 40*b*, and into an internal area 40d within the valve 40; however, the valve 40 will not allow any fluid communication from the internal area 40*d*, through the check valve 40*b*, and into the external area 40*c* around the valve 40. This check valve 40*b* is designed to be the opposite of the check valve 30*a*1 shown in FIG. 3. A rupture disc 40*e* is disposed within the outer housing 40*a*; however, this rupture disc 40*e* is fluidly connected to the internal area 40*d* of the valve 40 via a port 40*f* which is fluidly connected between the internal area 40*d* and the rupture disc 40*e*. As a result, the rupture disc 40*e* will rupture when a tubing pressure (the pressure inside a tubing string connected to the valve 40 in the wellbore, not an annulus pressure around the valve) exceeds a predetermined threshold pressure value rating of the rupture disc 40*e*. A mandrel 40*g* is enclosed by the outer housing 40*a* and is movable longitudinally within the outer housing 40*a*. The mandrel 40*g* includes a piston 40*g*1, the piston 40*g*1 separating a first chamber 40*i* from a second chamber 40*j* and a port 40*g*2 which is disposed through the mandrel 40*g*. The port 40*g*2 is adapted to move into and out of alignment with the check valve 40*b* when the mandrel 40*g* is moved longitudinally within the outer housing 40*a*. A communication channel 40*h* is fluidly connected between the rupture disc 40*e* and the first chamber 40*i*, the channel 40*h* propagating a pressure from the rupture disc 40*e* when the rupture disc 40*e* is ruptured in response to a predetermined tubing pressure existing inside the internal area 40*d* of the valve 40.

In operation, in FIG. 4, the auto cushion valve 40 is initially disposed in a condition where the port 40*g*2 through the mandrel 40*g* is in alignment with the check valve 40*b* and the rupture disc 40*e* has not yet been ruptured. In this condition, the valve 40 can and does receive wellbore fluid from the external area 40*c* around the valve 40 (the annulus area between the valve 40 and a wall of the wellbore) when the valve is disposed in the wellbore for filling up the tubing string connected to the valve 40 and to establish cushion pressure inside the tubing string. When the cushion pressure inside the valve 40 and its associated tubing string has reached its desired value, the pressure inside the tubing string and inside the valve 40 (the tubing pressure) is increased until such tubing pressure reaches a predetermined value. At this point, the predetermined tubing pressure will enter the port 40*f* from inside the value and inside the tubing, rupture the rupture disc 40*e*, and propagate through the ruptured rupture disc, along the channel 40*h*, to the first chamber 40*i* where such tubing pressure will be exerted on one side of the piston 40*g*1. In response, the piston 40*g*1 and the mandrel 40*g* will move in a first direction. When the mandrel 40*g* moves in the first direction, the port 40*g*2 will move out of alignment with the check valve 40*b* thereby preventing any further wellbore fluid from moving from the external area 40*c*, through the check valve 40*b*, and into the internal area 40*d* of the valve 40 and its associated tubing string.

The auto cushion valve 40 is a rupture disc tubing pressure actuated valve. The check valve 40*b* allows flow from an annulus to a tubing for filling in the tubing string, but checks the flow from tubing to annulus so that tubing pressure can be increased to rupture the rupture disc 40*e*. Once the desired cushion pressure is achieved, the tubing pressure is increased to rupture the disc 40*e* and the mandrel 40*g* shifts forward closing the flow ports 40*g*2/40*b*.

If the well is perforated and the formation is taking fluid or the tool is run in open hole, it may not be possible to increase the annulus pressure to rupture the rupture disc for activating the valve 40. The check valve 40*b* and port 40*g*2 allow free fluid flow from the annulus to the tubing for filling up the tubing to establish cushion pressure but, at the same time, check (prevent) the flow from the tubing to the annulus so that the rupture disc 40*e* can be ruptured by increasing the tubing string pressure.

Referring to FIG. 5, the check valve 30*a*1 in FIG. 3 and the check valve 40*b* in FIG. 4 are illustrated. FIG. 5 is a cross section of the check valve 30*a*1 in FIG. 3 taken along section lines 5'—5' in FIG. 3 and of the check valve 40*b* in FIG. 4 taken along section lines 5"—5" of FIG. 4. In FIG. 5, the check valve 30*a*1/40*b* comprises ball check area 50 which is the area in the check valve where a ball 50 of the check valve sits, and an annular flow area 52, which includes a plurality of individual annular flow ports 52*a* into which the wellbore fluid will flow. When the ball 50*a* sits directly on the ball check area 50, the wellbore fluid disposed inside (FIG. 3) and outside (FIG. 4) the valve can only flow into the annular flow ports 52*a* in one direction only; that is, the wellbore fluid cannot flow into the ports 52*a* in a direction which is opposite to the one direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A valve adapted to be disposed in a wellbore, a wellbore fluid having a pressure being disposed around said valve within an annulus of said wellbore, comprising:

an outer housing including a port disposed therethrough;

a mandrel enclosed by said housing and adapted to move within said housing, said mandrel including a piston and a port disposed through said mandrel adapted to align with said port in said outer housing when said mandrel moves within said housing;

a rupture disc disposed within said housing, said rupture disc being adapted to rupture when said pressure of said wellbore fluid in said annulus is greater than or equal to a predetermined threshold pressure value, said rupture disc being in fluid communication with said piston of said mandrel when said rupture disc is ruptured; and a flapper valve adapted to be operated by said mandrel and adapted to be disposed in a first condition and a second condition, said flapper valve being held in said first condition when said flapper is restrained by said mandrel, said rupture disc rupturing when said pressure of said wellbore fluid in said annulus is greater than or equal to said predetermined threshold pressure value, said wellbore fluid fluidly communicating with said piston of said mandrel when said rupture disc ruptures, said mandrel moving within said housing when said wellbore fluid in said annulus fluidly communicates with said piston of said mandrel, said flapper valve changing from said first condition to said second condition when said mandrel moves within said housing, said port disposed through said mandrel aligning with said port in said outer housing after said flapper valve changes to said second condition.

2. The valve of claim 1, further comprising:

a second flapper valve adapted to be operated by said mandrel and adapted to be disposed in said first condition and said second condition, said second flapper valve being held in said first condition when said flapper is restrained by said mandrel.

3. The valve of claim 2, wherein said second flapper valve changes from said first condition to said second condition when said mandrel moves within said housing, said port disposed through said mandrel aligning with said port in said outer housing after said flapper valve and said second flapper valve change to said second condition.

4. The valve of claim 3, wherein said first condition is an open valve condition and said second condition is a closed valve condition.

5. The valve of claim 3 further comprising a time delay for aligning said ports a set time after operation of said second flapper valve.

6. The valve of claim 5 wherein said time delay is an oil metering orifice between two oil chambers.

7. The valve of claim 2 further comprising a time delay for aligning said ports a set time after operation of said second flapper valve.

8. The valve of claim 7 wherein said time delay is an oil metering orifice between two oil chambers.

9. The valve of claim 1 further comprising a time delay for aligning said ports a set time after operation of said flapper valve.

10. The valve of claim 9 wherein said time delay is an oil metering orifice between two oil chambers.

11. A method of operating a valve, comprising the steps of:

rupturing a rupture disc by exposing said disc to a predetermined pressure difference;

moving a mandrel in response to said rupturing of said disc;

closing a flapper valve in response to said moving of said mandrel; and after said flapper valve is closed, aligning and opening a pair of reverse circulation ports in response to said moving of said mandrel.

12. Apparatus adapted to be disposed in a wellbore for directing fluid flow whenever a wellbore fluid having a pressure is disposed around said apparatus within an annulus of said wellbore, comprising:

first valve means having a first state for controlling fluid flow in a first path;

second valve means having a second state when said first valve means is in said first state;

wherein, when said first valve means is forced into a second state, said second valve means is forced into a first state for controlling fluid flow in a second path;

means for switching said first and second valve means between said first and second states; and further comprising a time delay for switching said second valve means to a first state a set time after said first valve means is switched to a second state.

13. The valve of claim 12 wherein said time delay is an oil metering orifice between two oil chambers.

14. Apparatus adapted to be disposed in a wellbore for directing fluid flow whenever a wellbore fluid having a pressure is disposed around said apparatus within an annulus of said wellbore, comprising:

first valve means having a first state for controlling fluid flow in a first path;

second valve means having a second state when said first valve means is in said first state;

wherein, when said first valve means is forced into a second state, said second valve means is forced into a first state for controlling fluid flow in a second path;

means for switching said first and second valve means between said first and second states;

wherein said first valve means is a flapper valve and said second valve means is a pair of ports; and further comprising a time delay for aligning said pair of ports a set time after operation of said flapper valve.

15. The valve of claim 14 wherein said time delay is an oil metering orifice between two oil chambers.

* * * * *